United States Patent [19]

Sterner, Jr.

[11] Patent Number: 5,046,889

[45] Date of Patent: Sep. 10, 1991

[54] ROLLING SCREED SPREADER BOX

[76] Inventor: Carl L. Sterner, Jr., 3860 Nord Rd., Bakersfield, Calif. 93312-9216

[21] Appl. No.: 446,558

[22] Filed: Dec. 5, 1989

[51] Int. Cl.[5] ..... E01C 19/28

[52] U.S. Cl. ..... 404/103; 404/105; 404/117; 404/132; 404/122

[58] Field of Search ..... 404/85, 101, 102, 103, 404/105, 117, 122, 132, 84, 113, 120, 133; 172/240

[56] References Cited

U.S. PATENT DOCUMENTS

| | | | |
|---|---|---|---|
| 1,665,054 | 4/1928 | Carr | 404/96 |
| 2,025,703 | 12/1985 | Baily | 404/117 |
| 3,198,293 | 10/1972 | Wagner | 188/163 |
| 3,415,174 | 12/1968 | Kaltenegger | 404/117 |
| 3,871,788 | 3/1975 | Barsby | 404/117 |
| 3,967,912 | 7/1976 | Parker | 404/84 |
| 4,011,023 | 3/1977 | Cutler | 404/91 |
| 4,219,287 | 8/1980 | Marks | 404/117 |
| 4,425,051 | 1/1984 | Gallaway | 404/72 |
| 4,577,995 | 3/1986 | Sadahiro | 404/117 |
| 4,647,247 | 3/1987 | Sandstrom | 404/117 X |
| 4,682,908 | 7/1987 | Domenighetti | 404/84 |
| 4,702,642 | 10/1987 | Musil | 404/96 X |
| 4,717,282 | 1/1988 | Anderson | 404/117 X |
| 4,759,657 | 7/1988 | Dorr et al. | 404/84 X |

*Primary Examiner*—Ramon S. Britts
*Assistant Examiner*—Roger J. Schoeppel
*Attorney, Agent, or Firm*—John W. Montgomery

[57] ABSTRACT

A spreader box for spreading cold mixed asphaltic concrete paving mixtures including a supporting frame or "bridge" attached to a left and right side plate. Within the spreader box and at the front portion of the box is situated a left and right side hydraulic motor or other power means, which is used to power a left and right side auger for lateral distribution of the paving mixture. Adjustment means on each end and in the middle to allow for vertical adjustment of the distribution auger. A left and right side "ROLLING SCREED" roll which has an adjustment means on each end and in the middle to allow for vertical adjustment of depth of spread.

A left and right side compression roll which has adjustment means at each end and in the center for vertical adjustment of down pressure. Screed roll and compression roll connected by chain and sprocket or other power transfer means. One or more wheels or caterpillar tracks are mounted on each side plate.

10 Claims, 3 Drawing Sheets

ROLLING SCREED SPREADER BOX

FIELD OF INVENTION

This invention relates to a spreading device or spreader box for applying, screeding to proper thickness and compacting cold mixed, emulsified asphaltic concrete paving mixtures on a prepared surface.

BACKGROUND AND CIRCUMSTANCES OF CONCEPTION

In 1985, I received a patent for a machine called a "POTHOLE PATCHER" which produced a cold mixed asphaltic concrete paving material, U.S. Pat. No. 4,511,284. This machine mixes, fills and compacts "potholes" with asphaltic concrete paving material. It has a roller on the front end which is lowered to the desired depth of spread and as the machine rolled forward over the patch it was spread out and smoothed to the desired thickness. After the pass to spread out and smooth the patch, the roller is then lowered further which raised the front end of the machine off the ground and the machine is put in reverse and the front roller then thoroughly compacts the paving mixture as the machine and roller backs over the patch. This machine worked very well for small "potholes" but we wanted to make a larger machine for full width highway paving using the cold mixed process. We found the cold mixed, sticky, asphalt paving material was next to impossible to smooth out and spread in preparation for rolling and compacting in large amounts. We tried many types of conventional asphalt spreading devices, both heated and unheated. None worked very well and most of the time the sticky cold mixed asphalt paving material would build-up in front of the screed and just slide along and not spread out. Cold mixed asphaltic concrete paving material has much the same characteristics as bread dough. Bread dough cannot be spread with a knife or blade, it must be spread and smoothed out with a "rolling pin". After building and trying many types of spreading devices, which did not work well. I finally hit upon the idea of putting a adjustable "rolling screed" in a spreader box followed by a compression roll. This works similar to our "pothole patcher" which employed a forward pass as a screed roll and a reverse pass as a compression roll.

My new invention is called the "Rolling Screed" Spreader Box. The "Rolling Screed" Spreader Box does a very smooth job of spreading cold mixed asphaltic concrete paving material.

SUMMARY AND DISCUSSION OF PRIOR ART

Categories covered are Class 404, Subclasses 101, 106. 117. 118, 119 and 122.

| PATENT | INVENTOR |
|---|---|
| 3,698,293 | Wagner |
| 1,665,054 | Carr |
| 2,025,703 | Bailey |
| 4,219,287 | Marks |
| 4,759,657 | Dorr |
| 3,415,174 | Kaltenegger |
| 4,682,908 | Domenighetti |

Foreign patent number 4,759,657 by Dorr shows a spreading device which employs an adjustable spreading "plank" but no rolling screed followed by a compression roll.

All the other devices are compaction devices and none have an auger for lateral distribution of material or an adjustable, screed roll or an adjustable compression roll. none can be operated without the compression roll.

Asphaltic concrete spreading devices, spreader boxes or spreader machines are well known and in wide spread use in the asphaltic concrete paving industry. All spreading machines or devices available today for spreading asphaltic concrete paving materials employ a strike off screed or blade or blade-plate for spreading or smoothing the asphaltic concrete paving mixture. These devices work very well for spreading hot mixed asphaltic concrete or oil cut-back mixtures because these materials flow easily. Cold mix asphaltic paving mixtures made with cold aggregate and cold asphalt emulsions do not flow easily and are very sticky and very hard to spread. Cold mixed asphaltic paving mixtures have characteristics similar to bread dough. You cannot spread and smooth bread dough with a knife blade. It can only be spread and smoothed with a rolling pin. Cold mixed asphaltic paving mixtures are much the same. These mixtures can be readily spread with a "ROLLING SCREED" but are very difficult to spread with conventional spreading devices employing a strike-off blade or blade-plate. The use of these conventional spreading devices for spreading cold mixed asphaltic concrete paving mixtures results in a very course surface with many "rock drags". Sometimes the cold sticky emulsion mixture will build-up in front of the screed and will not go under the screed at all. The "ROLLING SCREED" Spreader Box completely solves this spreading problem and will lay a very smooth surface with absolutely no "rock drags" or build-up in front of the screed.

BRIEF SUMMARY OF INVENTION

The "ROLLING SCREED" Spreader Box is an improved method for spreading and laying cold mixed asphaltic concrete paving mixtures made with cold aggregate and cold asphalt emulsion as a binder. Cold mixed asphalt paving mixtures made with asphalt emulsion at ambient temperatures and cold aggregate have much the same characteristics as bread dough. You cannot spread bread dough with a knife blade, it must be spread and smoothed with a rolling pin. Cold mixed asphaltic paving material is much the same. It does not spread well with conventional spreading devices which employ a screed blade or plate strike off device. The "ROLLING SCREED" works well with cold asphaltic concrete mixtures because the roll turns as the cold, sticky asphalt emulsion mixture passes under the "ROLLING SCREED", resulting in a very smooth surface with absolutely no "rock drags". The "ROLLING SCREED" Spreader Box is equipped with two augers, one on each side of the spreader box. Each auger is reversible in either direction so that the paving mixture can be readily moved from one side of the box to the other. The "ROLLING SCREED" is situated in the spreader box, between the auger and compression roller and is adjustable up or down depending one the desired thickness of the "spread". In back of the "ROLLING SCREED" is a compression roller. As the cold asphalt mixture passes under the screed it is screeded to the desired thickness and partially compacted. The compression roller then further compacts the paving mixture. The "ROLLING SCREED" and compression roller may both be connected with sprockets and chain so that the screed roll and compression roll both turn together, if desired, at the same speed. Both rolls are equipped with a pad for applying a release agent to the roll. The "ROLLING SCREED" Spreader Box has two wheels mounted in the front of the spreader box, one at each front corner to allow for easy travel over the bituminous surface, it can also, be equipped with caterpillar tracks as an option. To change thickness of spread, screw adjustments or other adjustment devices at each side and in the center allow for easy adjustment up or down of the "ROLLING SCREED", compression roll and auger. The "ROLLING SCREED" Spreader Box can be made with a "telescoping" frame or bridge and "telescoping" rollers to vary the width of the spreader box. The "ROLLING SCREED" Spreader Box can be operated without the compression roll or with the compression roll in the raised position. The paving mixture would then be compacted by conventional means. No heating of the rock or asphalt binder is required for cold mixed asphaltic concrete paving mixtures. This makes a better and longer lasting pavement because the oils and plasticizers are not burnt up in the heating process. Last year in the United States approximately 500,000,000 tons of hot mixed asphaltic concrete paving materials were produced. It takes approximately three gallons of fuel oil to heat one ton of hot mixed paving material. Figuring fuel oil at $1 00 per gallon, equals a savings of $1,500,000,000.00 for the construction industry, if all asphaltic paving materials were made with the cold mixed process and spread with the "ROLLING SCREED". Pollution would be greatly reduced by not burning 1,500,000,000 gallons of fuel oil. This would also, make our country more energy self sufficient and reduce our dependence on foreign oil producing nations.

BRIEF DESCRIPTION OF THE DRAWINGS

FIG. #1 of 5 is an isometric view of the "ROLLING SCREED" Spreader Box according to the present invention.

FIG. #2 of 5 is a top view showing the placement of the right and left hand distribution augers, right and left "ROLLING SCREED", right and left compression rollers, height adjustment screws, hydraulic motor, sprockets, drive chains and lifting bar.

Figure 1:
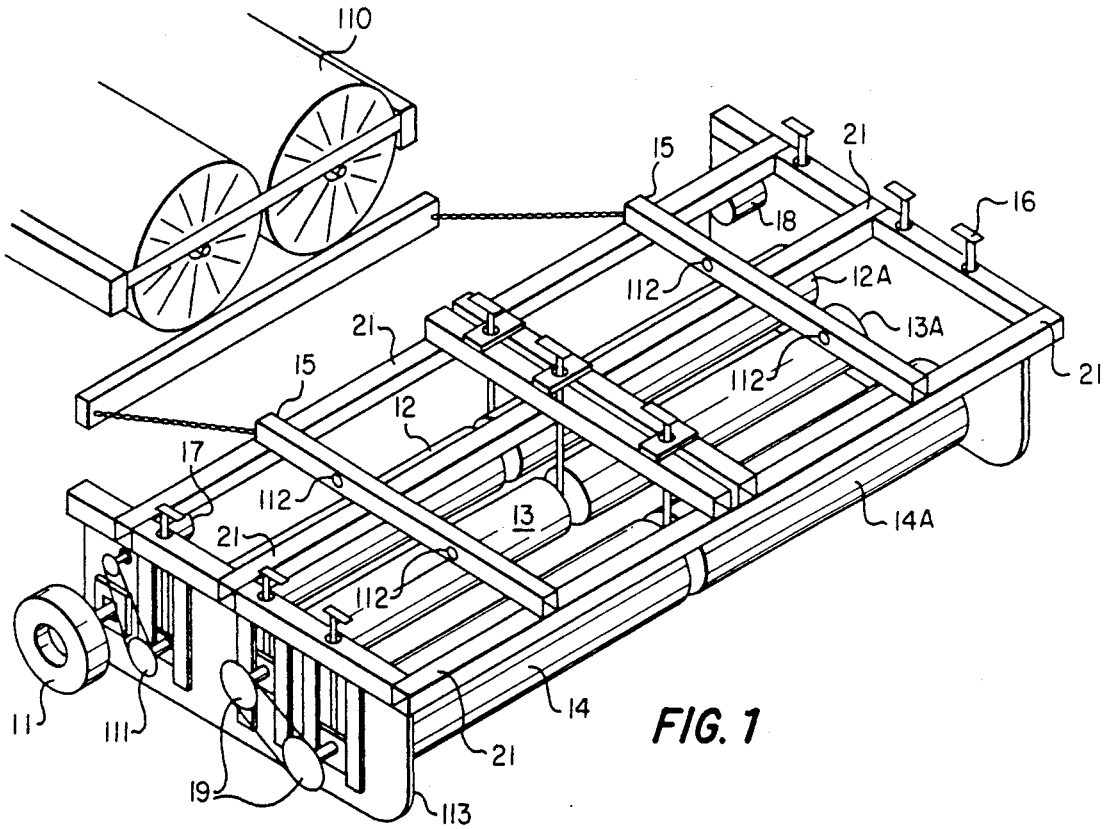
Figure 2:
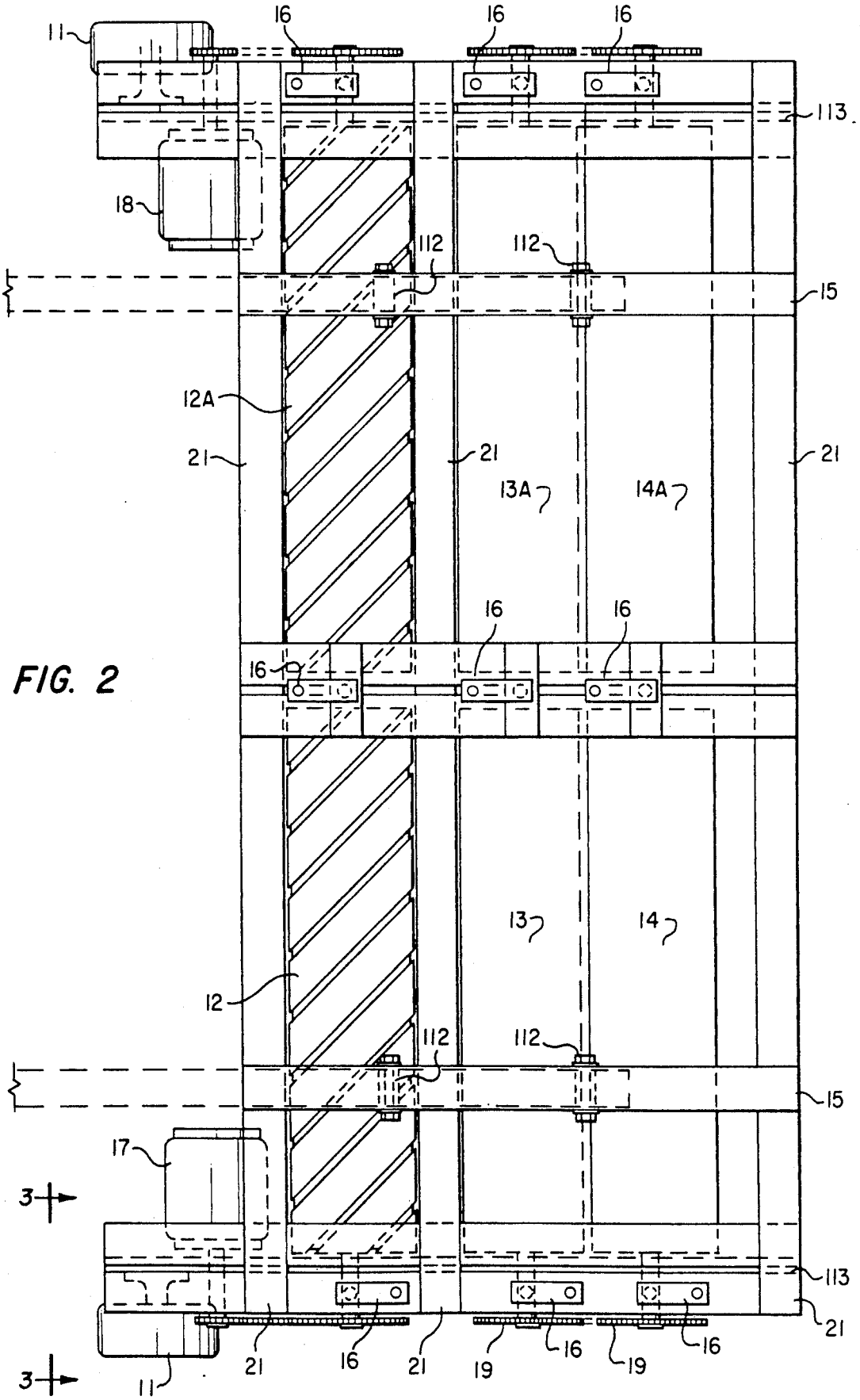
Figure 3:
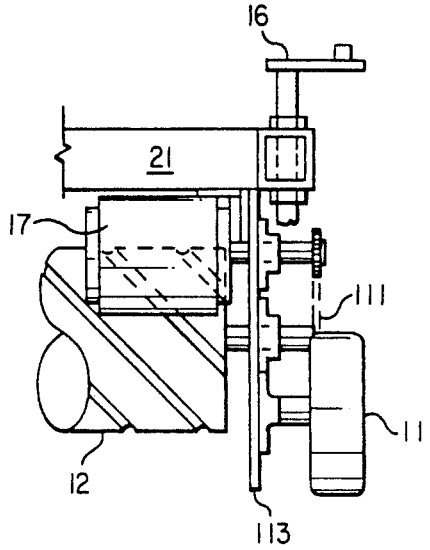
Figure 4:
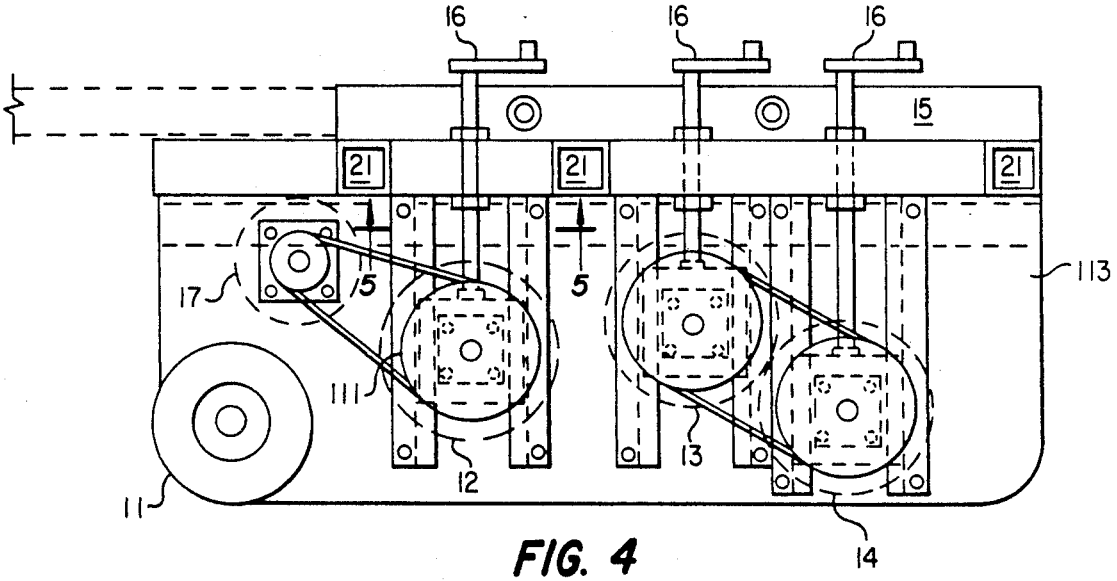
Figure 5:
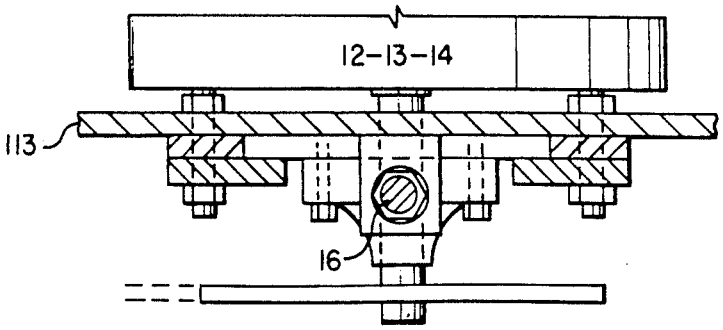

FIG. #3 of 5 shows a partial view of the distribution auger, power means, sprockets and chain to drive auger, front wheel and typical adjustment screw for auger, "ROLLING SCREED" and compression roll.

FIG. #4 of 5 is a side view showing the side plates, lifting and tow bar, power means, adjustable auger, adjustable "ROLLING SCREED", adjustable compression roller, drive sprockets, chains, front wheel and typical adjusting screws for setting the depth of spread.

FIG. #5 of 5 shows a typical detail of the height adjustment apparatus for the auger, "ROLLING SCREED" and compression roller. It also, shows the bearing holder sliding adjustment apparatus and adjustment screw for the height adjustment of auger, "ROLLING SCREED" and compression roller. It shows the side plate, frame and drive chain sprocket.

DETAILED DESCRIPTION OF DRAWINGS

Referring now to FIG. #1 there is shown a "ROLLING SCREED" Spreader Box being pulled by a truck mixer tow vehicle (110). The truck mixer (110) thoroughly combines the cold emulsified asphalt with the cold aggregate and deposits the mixture immediately in front of the "ROLLING SCREED" Spreader Box. As the "ROLLING SCREED" Spreader Box is pulled forward the hydraulic motors (17 and 18) turns the left and right side augers (12 and 12A) which contacts the paving mixture and distributes the material laterally as desired. The left and right side "ROLLING SCREEDS" (13 and 13A) levels off the paving mixture to the desired depth of spread. The compression rolls (14 and 14A) then compacts the paving material and the down pressure of the compression rolls (14 and 14A) causes the "ROLLING SCREED" (13 and 13A) to turn at the same RPM as the compression roll (14 and 14A) because they are connected by chain and sprocket (19). The "ROLLING SCREED" Spreader Box can be operated without the compression roll (14 and 14A) or with the compression roll in the raised position. The paving mixture would then be compacted by conventional asphalt rollers. The "ROLLING SCREED" Spreader Box includes a pair of front wheels (11), (only one of which is shown in FIG. #1), a left side power means (17) connected by sprocket and drive chain to left side auger sprocket (111), (right side sprocket and drive chain not shown). a left side auger (12) and a right side auger (12A) for distributing the paving mixture laterally as necessary, left side sprocket and drive chain (19) connecting the left side "ROLLING SCREED" (13) and the left side compression roll (14), (right side sprockets and chain not shown).

Right side power means drive motor (18) transfers power via chain and sprockets (not shown) to the right side auger (12A). The right side "ROLLING SCREED" (13A) is connected by chain and sprocket (not shown) to the compression roll (14A), the connection by chain and sprocket between the left and right "ROLLING SCREED" (13 and 13A) and left and right compression rolls (14 and 14A) makes the screed roll and compression roll turn at the same RPM thereby, eliminating any possibility of a build-up in front of screed roll and absolutely no "rock drags". A lifting tow bar (15), lifting eyelet (112), height adjustment screws (16), (typical), for adjusting the depth of spread, a left side plate (113), (typical of right side), frame or bridge (21).

Referring now to FIG. #2 shows a top view of the "ROLLING SCREED" Spreader Box. Left and right front wheels (11), left and right side power means drive motors (17 and 18) to power the left and right augers (12 and 12A), handles for height adjusting screws (16), (typical), lifting bars (15), lifting eyelets (112), left and right side "ROLLING SCREED" (13 and 13A), left and right side compression rolls (14 and 14A), left and right side plates (113), (typical), frame or bridge (21).

Referring now to FIG. #3 shows a detail of the left side hydraulic motor (17), the left side auger (12), drive sprockets and drive chains (111) to transfer power to the auger. Height adjustment screw (16), (typical), side plate (113), and front wheel (11), frame or bridge (21).

Referring now to FIG. #4 shows a side view of the "ROLLING SCREED" Spreader Box, a left front wheel (11), (typical), a left side sprocket and chain drive system (111) to power the left side auger (12). A "ROLLING SCREED" (13), a left side compression roll (14), a left side plate (113), a left side lifting and tow bar (15), a pair of left side lifting eyelets (112), (typical), height adjustment screws for adjusting depth of spread (16), (typical), frame and bridge (21).

Referring now to FIG. #5 shows a typical detail of the adjusting device (16) and bearing holder for the auger (12), "ROLLING SCREED" (13), compression roll (14) drive sprocket (111) and side plate (113).

What is claimed is:

1. A spreading device for applying a cold mixed asphaltic concrete paving material comprising:

(a) a fixed or extendable frame spreader box;

(b) an auger attached within said frame and powered for lateral distribution of a paving mixture within said spreader box;

(c) an adjustable screed roll for screeding or spreading the paving mixture to a desired depth of spread of said paving mixture;

(d) an adjustable compression roll for compacting the paving mixture;

(e) conveyance means on each side of said spreader box;

(f) adjustment means at the ends and in the middle of said auger, said screed roll, and said compression roll to adjust the depth of spread of said paving mixture; and (g) a rotational power transmission means connected between said compression roll and said screed roll.

2. A spreading device for applying a cold mixed paving material to a surface to be paved comprising:

(a) a frame of a width substantially equal to the width of said surface to be paved and having left and right sides;

(b) auger means rotationally attached to said frame spaced above and substantially parallel to said surface to be paved for distribution of said cold mix paving material in a layer across and along said surface to be paved; and (c) a rolling screed rotationally attached to said frame adjacent and substantially parallel to said auger means and spaced above said surface to be paved for spreading said cold mix paving material in a substantially flat layer across and along said surface to be paved.

3. A spreading device as in claim 2 further comprising a compression roller attache for rotation to said frame adjacent to said rolling screed and substantially parallel thereto.

4. A spreading device as in claim 3 further comprising:

(a) means for adjusting the height of said rolling screed; and (b) means for adjusting the height of said compression roller.

5. A spreading device as in claim 4 wherein:

(a) said means for adjusting the height of said rolling screed comprises adjusting screws at the right and left sides of said frame; and (b) said means for adjusting the height of said compression roller comprises adjusting screws at the right and left sides of said frame.

6. A spreading device as in claim 3 further comprising a power transmission means for inter-connecting the rotation of said rolling screed with the rotation said compression roller so that build up of paving material between said rolling screed and said compression roller is reduced and "rock drag" is avoided.

7. A spreading device as in claim 3 further comprising:

(a) a first applicator means attached to said frame for applying releasing agent to said rolling screed; and (b) a second applicator means attached to said frame for applying release agent to said compression roller.

8. A spreading device as in claim 2 wherein said auger means further comprises:

(a) a left side auger independently powered for selectable rotation for moving cold mix toward the left or toward the middle of said frame; and (b) a right side auger axially aligned with said left side auger and independently powered for selectable rotation for moving cold mix toward the right or toward the middle such that said selectable powering of said augers can be used to distribute cold mix material in a substantially even layer across said frame width.

9. A spreading device as in claim 8 further comprising means for adjusting the height of said right and left augers.

10. A spreading device as in claim 9 wherein said means for adjusting the height of said right and left augers comprises adjusting screws at the left side, middle and right side of said frame.

* * * * *

UNITED STATES PATENT AND TRADEMARK OFFICE

CERTIFICATE OF CORRECTION

PATENT NO. : 5,046,889

DATED : September 10, 1991

INVENTOR(S) : Carl L. Sterner, Jr.

It is certified that error appears in the above-identified patent and that said Letters Patent is hereby corrected as shown below:

Title Page:

In the Abstract:

Line 1, insert --is disclosed-- after "spreader box".

Line 3, delete the word "a".

Line 3, replace "plate" with --plates--.

Line 4, replace "is" with --are--.

Line 5, delete the word "a".

Line 5, replace "motor" with --motors--.

Line 6, replace "is" with --are--.

Line 6, delete the word "a".

Line 7, replace "auger" with --augers--.

Line 8, insert --provided-- after the word "means".

Line 8, delete "to".

UNITED STATES PATENT AND TRADEMARK OFFICE

CERTIFICATE OF CORRECTION

PATENT NO. : 5,046,889

DATED : September 10, 1991

INVENTOR(S) : Carl L. Sterner, Jr.

It is certified that error appears in the above-identified patent and that said Letters Patent is hereby corrected as shown below:

Line 10, replace "roll" with --rollers--.

Line 11, delete "which".

Line 11, replace "has an" with --have--.

Line 14, replace "A left" with --Left--.

Line 14, replace "roll" with --rollers--.

Line 14, replace "which has" with --have--.

Line 16, replace "roll" with --rollers--.

Line 17, replace "roll" with --rollers are--.

Column 2, lines 19-24, the following should be deleted: "Cold mixed asphaltic paving mixtures have characteristics similar to bread dough. You cannot spread and smooth bread dough with a knife blade. It can only be spread and smoothed with a rolling pin. Cold mixed asphaltic paving mixtures are much the same."

UNITED STATES PATENT AND TRADEMARK OFFICE

CERTIFICATE OF CORRECTION

PATENT NO. : 5,046,889

DATED : September 10, 1991

INVENTOR(S) : Carl L. Sterner, Jr.

It is certified that error appears in the above-identified patent and that said Letters Patent is hereby corrected as shown below:

Column 2, line 62, replace "one" with --on--.

Column 3, line 40, delete "of 5".

Column 3, line 43, delete "of 5".

Column 3, line 48, delete "of 5".

Column 3, line 52, delete "of 5".

Column 3, line 57, delete "of 5".

Column 3, line 61, insert --the-- before "auger".

Column 4, line 5, insert --,-- after the word "forward".

Column 4, line 5, replace "turns" with --turn--.

Column 4, line 6, replace "contacts" with --contact--.

Column 4, line 9, replace "levels" with --level--.

Column 4, line 11, replace "compacts" with --compact--.

UNITED STATES PATENT AND TRADEMARK OFFICE

CERTIFICATE OF CORRECTION

PATENT NO. : 5,046,889

DATED : September 10, 1991

INVENTOR(S) : Carl L. Sterner, Jr.

It is certified that error appears in the above-identified patent and that said Letters Patent is hereby corrected as shown below:

Column 4, line 13, replace "SCREED" with --SCREEDS--.

Column 4, line 14, replace "roll" with --rolls--.

Column 4, line 17, replace "roll" with --rolls--.

Column 4, line 18, replace "roll" with --rolls--.

Column 4, line 24, insert --the-- before the word "left".

Column 4, line 31, insert --,-- after the word "means".

Column 4, line 31, insert --,-- after "(18)".

Column 4, line 39, replace "roll" with --rolls--, two places.

Column 4, line 41, insert --the-- before the word "screed".

In the Claims:

Claim 2, column 5, line 28, replace "substantially equal to" with --at least as wide as--.

UNITED STATES PATENT AND TRADEMARK OFFICE

CERTIFICATE OF CORRECTION

PATENT NO. : 5,046,889

DATED : September 10, 1991

INVENTOR(S) : Carl L. Sterner, Jr.

It is certified that error appears in the above-identified patent and that said Letters Patent is hereby corrected as shown below:

Claim 3, column 5, line 44, replace "attache" with --attached--.

Claim 7, column 6, line 22, insert --pad-- after the word "first".

Claim 7, column 6, line 23, replace "releasing" with --release--.

Claim 8, column 6, line 29, delete "independently".

Claim 8, column 6, line 33, delete "and independently".

Claim 8, column 6, line 34, insert --independent of said left side auger-- after the word "rotation".

Claim 8, column 6, lines 35 and 36, replace "powering" with --rotation--.

Signed and Sealed this

Thirteenth Day of April, 1993

*Attest:*

STEPHEN G. KUNIN

*Attesting Officer*

*Acting Commissioner of Patents and Trademarks*